US008082833B1

(12) United States Patent
Hardin et al.

(10) Patent No.: US 8,082,833 B1
(45) Date of Patent: Dec. 27, 2011

(54) MACHINE GUN BOLT PIN LOCKING APPARATUS

(75) Inventors: James A. Hardin, McKinney, TX (US); Michael F. Ingersoll, Lowry Crossing, TX (US)

(73) Assignee: Contract Fabrication and Design, LLC, Princeton, TX (US)

( * ) Notice: Subject to any disclaimer, the term of this patent is extended or adjusted under 35 U.S.C. 154(b) by 319 days.

(21) Appl. No.: 12/418,733

(22) Filed: Apr. 6, 2009

Related U.S. Application Data

(60) Provisional application No. 61/052,755, filed on May 13, 2008.

(51) Int. Cl.
*A01H 5/02* (2006.01)

(52) U.S. Cl. ..... 89/9; 89/1.4; 42/70.01; 70/34

(58) Field of Classification Search ..... 89/9, 11, 89/1.4, 138; 42/70.11; 70/34; 292/340, 292/340.15, 163, 174, 175, 177, 179
See application file for complete search history.

(56) References Cited

U.S. PATENT DOCUMENTS 1,460,415 A * 7/1923 Gorton ..... 89/1.4
1,653,319 A * 12/1927 Studler ..... 89/1.14
2,384,725 A * 9/1945 Chapman ..... 89/1.4
4,565,113 A * 1/1986 Bunning ..... 89/1.4
5,024,138 A * 6/1991 Sanderson et al. ..... 89/37.22
6,553,793 B1 * 4/2003 Chen ..... 70/33
2005/0011345 A1 * 1/2005 Herring ..... 89/1.4

OTHER PUBLICATIONS

Definition of the Term "Strip". The American Heritage® Dictionary of the English Language, Fourth Edition copyright © 2000 by Houghton Mifflin Company. Updated in 2009. Published by Houghton Mifflin Company. All rights reserved.*

* cited by examiner

*Primary Examiner* — Gabriel Klein
(74) *Attorney, Agent, or Firm* — Haynes and Boone, LLP

(57) ABSTRACT

To safely and reliably hold the forwardly spring-biased bolt assembly of a machine gun in a rearwardly disposed position within the receiver portion of the gun, a specially designed locking apparatus is mounted on an exterior side surface portion of the receiver. The locking apparatus has a slot therein which is operative to rearwardly receive a bolt pin portion of the bolt assembly which is anchored to the bolt assembly for reciprocating motion therewith and projects outwardly through a sidewall slot in the receiver for reciprocating motion with the bolt assembly. To releasably lock the bolt assembly in its rearward position the bolt pin is rearwardly moved into the locking apparatus slot, and a latch portion of the locking apparatus is moved to block forward exit of the pin from the locking apparatus slot.

20 Claims, 6 Drawing Sheets

MACHINE GUN BOLT PIN LOCKING APPARATUS

CROSS REFERENCE TO RELATED APPLICATION

This application claims the benefit of the filing date of U.S. Provisional Application Ser. No. 61/052,755 filed on May 13, 2008 and entitled "Machine Gun Bolt Pin Locking Apparatus", such provisional application being hereby incorporated herein by reference in its entirety.

BACKGROUND OF THE INVENTION

The present invention generally relates to machine gun apparatus and, in a representatively illustrated embodiment thereof, more particularly relates to a specially designed machine gun bolt pin locking apparatus.

In a conventional machine gun such as, for example, a .50 caliber machine gun, the body or receiver portion of the gun has disposed therein a bolt assembly which reciprocates forwardly and rearwardly as the gun is fired. The bolt assembly is strongly spring-biased in a forward direction, and carries a bolt pin member which projects outwardly through a horizontally elongated slot on a vertical side wall of the receiver for reciprocation with the bolt assembly. To enable the manual rearward movement of the bolt assembly, an external charging handle is typically secured to the outwardly projecting bolt pin.

Access to the interior of the receiver, and the bolt assembly therein, is provided by means of an access door carried by the receiver. The interior of the receiver is typically accessed through this door to clear ammunition jams, and, during an idle period of the gun after a firing sequence, to hold the bolt assembly (and the next-to-be fired round which it caries) rearwardly away from the still-hot barrel to prevent an undesirable "cook-off" firing of the next round by the heat of the barrel.

As is conventionally practiced, this holding of the bolt assembly in such rearward orientation away from the barrel, is accomplished by opening the receiver access door, pulling the bolt assembly rearwardly using the exterior charging handle secured thereto, and then pivotally moving a round extractor structure within the interior of the receiver until the round extractor is braced against the receiver interior in a manner preventing the spring-biased bolt assembly from snapping back to its original forwardly disposed position within the receiver.

Unfortunately, injury to operators' hands and fingers within the receiver interior is not an uncommon occurrence due to slippage of the repositioned round extractor structure which permits he rearwardly held bolt assembly to rapidly and very strongly snap back to its forwardly disposed position within the interior of the receiver. For this reason it can readily be seen that a need exists for a safer and more reliable technique for holding the spring-loaded bolt assembly in a rearwardly disposed orientation within the interior of the receiver. It is to this need that the present invention is directed.

SUMMARY OF THE INVENTION

In carrying out principles of the present invention, in accordance with a representatively illustrated embodiment thereof, a specially designed bolt pin locking apparatus is provided for use with a machine gun having a receiver from which an outer end portion of an internal bolt pin outwardly projects through a horizontally elongated slot, representatively disposed in a side wall of the receiver opposite from the side wall from which the charging handle outwardly projects, the bolt pin being movable between forward and rearward positions relative to the receiver and being spring-biased toward the forward position.

From a broad perspective, the bolt pin locking apparatus comprises a body adapted to be externally mounted on the receiver rearwardly of an outer end portion of the bolt pin in its forward position and having a slot formed therein, the slot having front and rear end portions and being configured to permit movement of the outer bolt pin end portion rearwardly therethrough to its rearward position. A latch member carried by the body for movement relative thereto, in a direction transverse to the direction of movement of the outer bolt pin end portion to its rearward position, between a locking position in which the latch member blocks the front end portion of the slot, to thereby be forcibly engaged by the outer bolt pin end portion and captively retain the outer bolt pin end portion in the slot, and an unlocking position in which the latch member unblocks the slot and permits the outer bolt pin end portion to be spring-returned to its forward position.

According to other aspects of the invention, a biasing spring structure may be carried by the bolt pin locking apparatus body and resiliently bias the latch member toward its unlocking position, and the latch member may have a rear side surface portion with an arcuate notch formed therein and positioned to be aligned with the slot when the latch member is in its locking position.

Further, the body may have an internal passage for receiving and captively retaining the latch member for movement relative to the body into and out of the slot, the internal passage transversely intersecting the slot. The latch member is illustratively strip-shaped and is carried by the body for longitudinal movement within the internal passage, the internal passage extending on opposite sides of the slot, with one portion of the internal passage receiving an end portion of the latch member only when the latch member is in its locking position.

The latch member may have a transversely projecting portion captively retaining a portion of the latch member within the internal passage. A biasing spring structure may be disposed within the internal portion, with the biasing spring structure bearing on the transversely projecting portion of the latch member and resiliently urging the latch member toward its unlocking position. Illustratively, the body may have a generally plate-shaped base portion in which a groove is formed, and a cover plate removably secured to the base portion over the groove, the internal passage being defined by the groove and a side surface portion of the cover plate, with the slot extending through the base portion and the cover plate.

DETAILED DESCRIPTION

Figure 1:
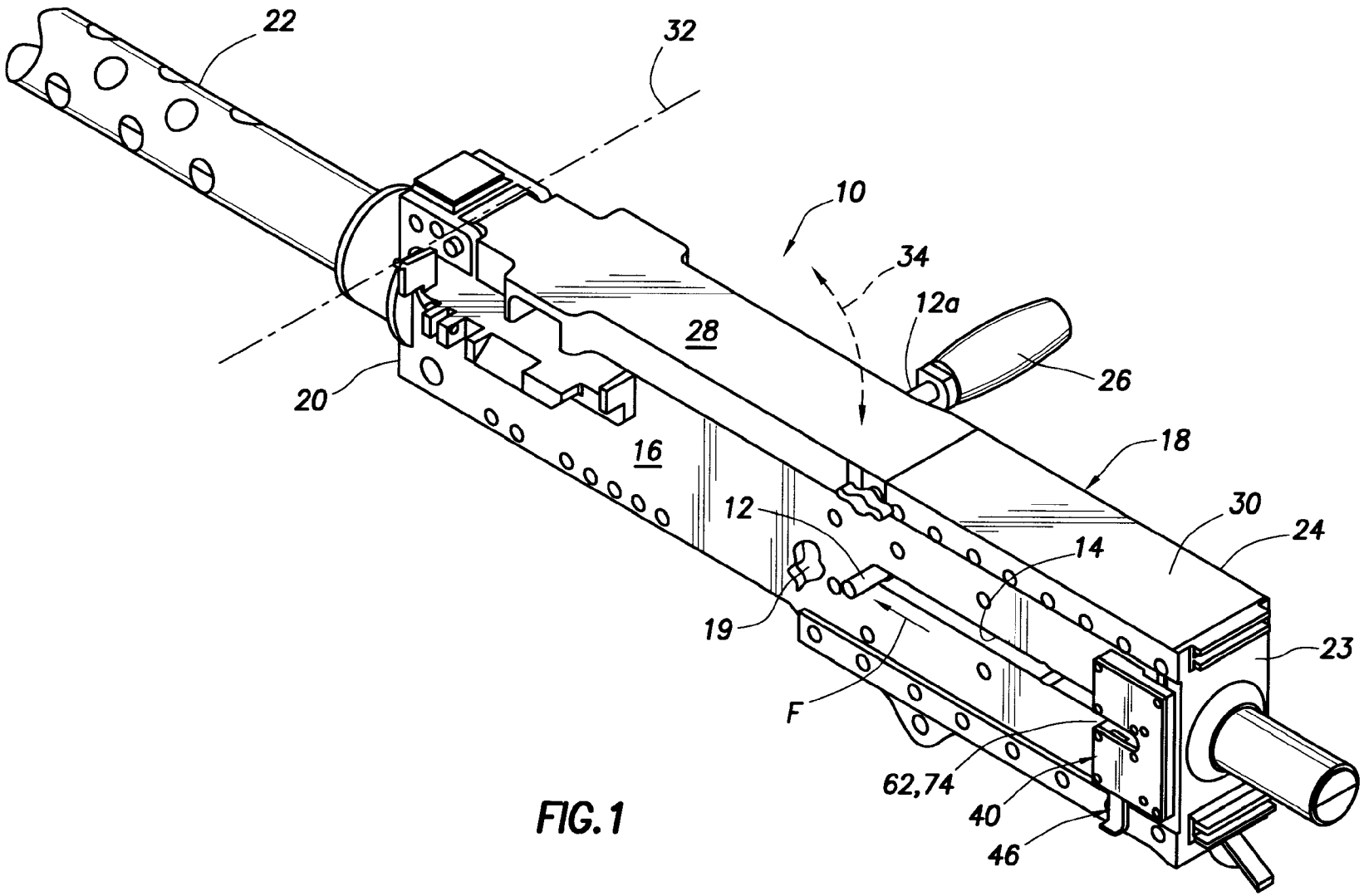
FIG. 1 is a longitudinally foreshortened, partially cut away perspective view of a representative machine gun upon which is operatively mounted an external bolt pin locking assembly embodying principles of the present invention, the bolt pin being in its forward orientation, and the locking assembly being in its unlocked position.
Figure 2:
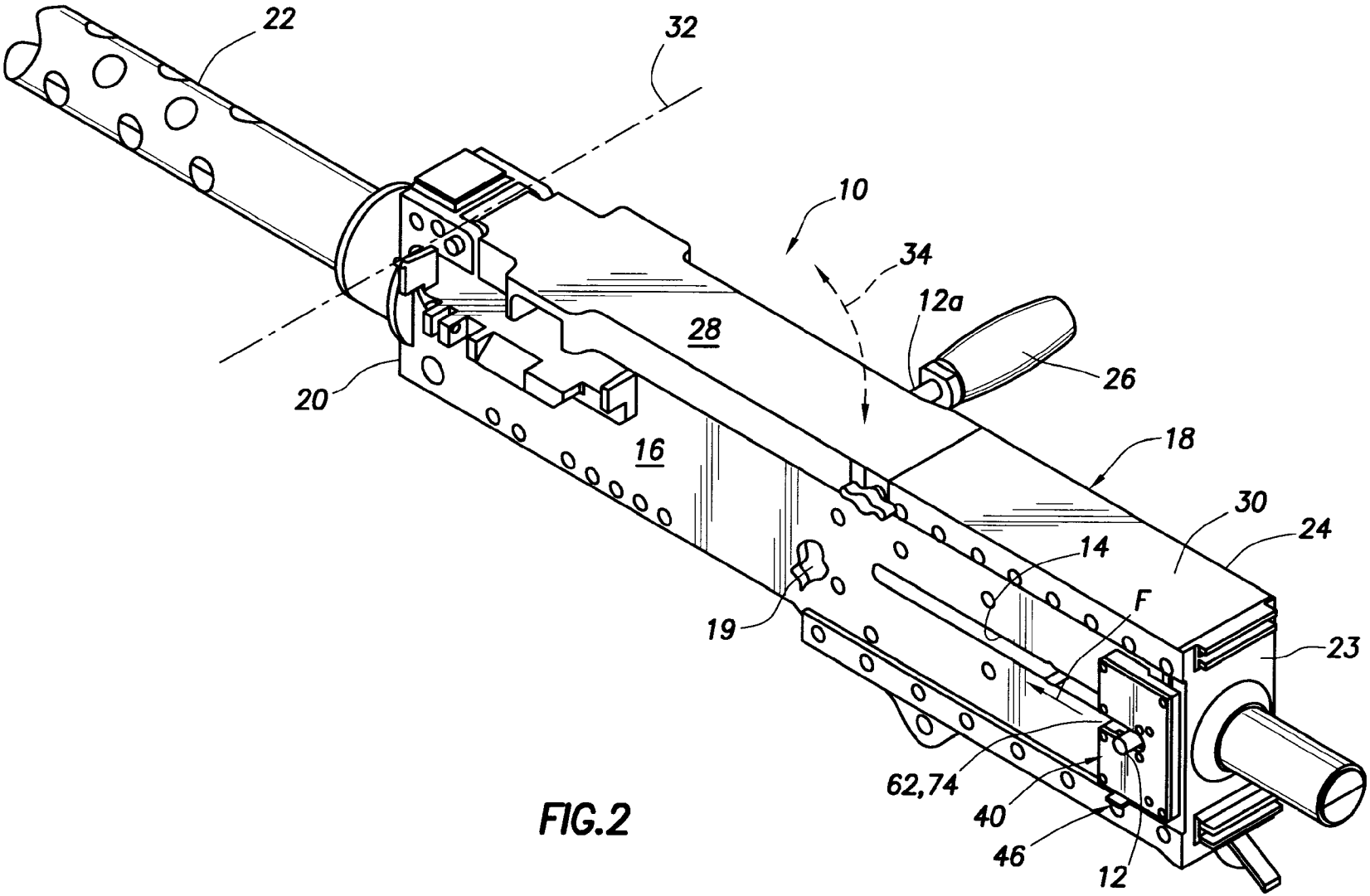
FIG. 2 is a view similar to that in FIG. 1, but with the machine bolt pin being releasably held in its rearward orientation by the locking assembly in its locked position.
Figure 3:
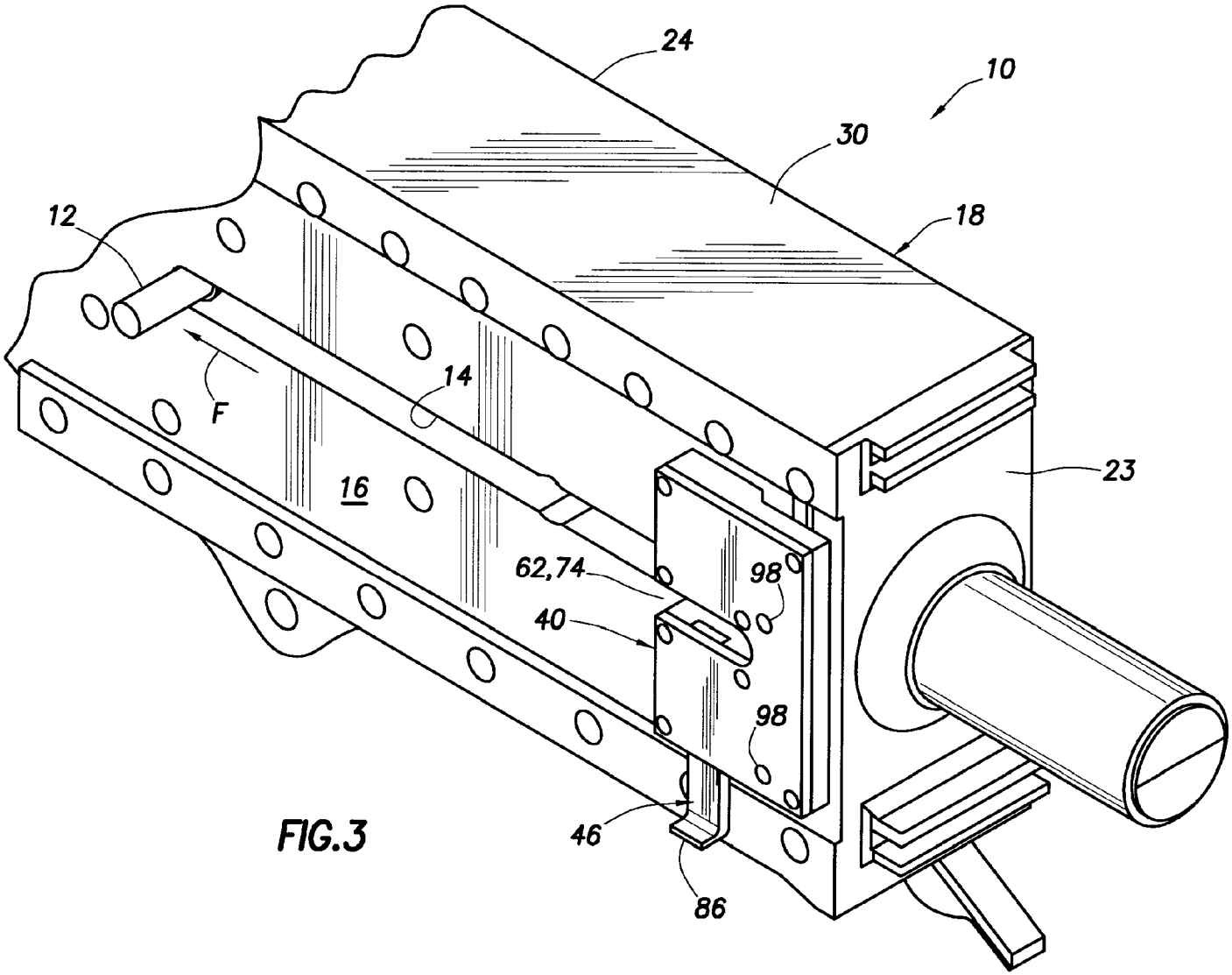
FIG. 3 is an enlarged scale perspective view of a rear end portion of the machine gun with the bolt pin locking assembly in its unlocked position.

Illustrated in FIGS. 1-3 is a machine gun 10 which is illustratively a .50 caliber machine gun, but could alternatively be a different type of machine gun having an external bolt pin 12. The representatively illustrated bolt pin 12 extends outwardly from a front-to-rear extending slot 14 formed in a left side wall 16 of the body or receiver portion 18 of the machine gun 10. During firing of the machine gun 10, the bolt pin 12 reciprocates forwardly and rearwardly in the slot 14. Disposed within the interior of the receiver 18 is a bolt assembly 19 which is secured to the bolt pin 12 for forward and rearward movement therewith relative to the receiver 18.

Receiver 18 has a front end 20 from which a barrel 22 forwardly extends, a rear end 23, and a right side wall 24 from which a charging handle 26 outwardly extends. The charging handle 26 is secured to a second bolt pin 12*a* that is also anchored to the bolt assembly 19 and extends outwardly through a horizontally elongated slot (not visible in the drawings) formed in the right side wall 24 of the receiver 18. By rearwardly pulling the charging handle 26 the bolt pin 12 may be pulled rearwardly, against the forward force F of a strong spring (not visible) within the receiver 18, from the forward position of the bolt pin 12 shown in FIGS. 1 and 3 to the rearward position of the bolt pin 12 shown in FIG. 2. This rearward movement of the charging handle 26 is used to cock the machine gun 10.

Access to the interior of the receiver 18, and the bolt assembly 19 therein, is provided by means of an access door 28 mounted on the top side 30 of the receiver 18 for pivotal opening and closing movement relative to the receiver 18 about a forwardly disposed axis 32 on the receiver 18 as indicated by the dashed, double ended arrow 34 in FIGS. 1 and 2. The purpose of such access is typically twofold—(1) to clear ammunition jams, and (2) during an idle period of the gun after a firing sequence, to hold the bolt assembly (and the next-to-be fired round which it carries) rearwardly from the still-hot barrel 22 to prevent an undesirable "cook-off" firing of the next round by the heat of the barrel 22.

As is conventionally practiced, this holding of the bolt assembly 19 in such rearward orientation away from the barrel 22, for either of the two noted receiver interior access purposes, is accomplished by opening the access door 28, pulling the charging handle 26 rearwardly (thus moving both the bolt pin 12 and the bolt assembly 19 rearwardly), and then pivotally moving a round extractor structure (not visible) within the interior of the receiver 18 until the round extractor is braced against the receiver interior in a manner preventing the spring-biased bolt assembly 19 from snapping back to its original forwardly disposed position within the receiver 18.

Unfortunately, injury to operators' hands and fingers within the receiver interior is not an uncommon occurrence due to slippage of the repositioned round extractor structure which permits the rearwardly held bolt assembly 19 to rapidly and very strongly snap back to its forwardly disposed position within the interior of the receiver 18. For this reason it can readily be seen that it would be desirable to provide a safer and more reliable technique for holding the spring-loaded bolt assembly 19 in a rearwardly disposed orientation within the interior of the receiver 18. To provide this desirable safety improvement, the present invention utilizes a specially designed bolt pin locking assembly 40 which is removably secured to the left side wall 16 of the receiver 18 adjacent the rear receiver end 23.

With reference now to FIGS. 4-7, the bolt pin locking assembly 40 is illustratively of a suitable metal construction and comprises a body formed from vertically elongated rectangular base plate and cover plate portions 42 and 44, a vertically elongated, generally strip-shaped bolt pin retention latch member 46, a pair of compression spring members 48, and a pair of spring stop pins 49.

Base plate 42 (see FIGS. 5-7) has outer and inner side surfaces 50 and 52, top and bottom end edge surfaces 54 and 56, and front and rear side edge surfaces 58 and 60. A slot 62 extends rearwardly through the front edge surface 58 at a vertically intermediate location thereon and has a curved rear end 64. A first recess 66 is formed in the inner side surface 52 of the base plate 42 and extends upwardly from the top side surface of the slot 62. A somewhat wider second recess 68 is also formed in the inner side surface 52 of the base plate 42, the second recess 68 being horizontally aligned with the first recess 66 and vertically extending outwardly through the bottom side surface of the slot 62 and the bottom end surface 56 of the base plate 42. The top end of the second recess 68 is narrowed by inwardly projecting wall portions 70 of the base plate 42, and the bottom end of the second recess 68 is narrowed by inwardly projecting wall portions 72 of the base plate 42. The stop pins 49 are retained in suitable mounting holes (not visible) formed in the base plate 42 just below the inwardly projecting top wall portions 70.

Figure 4:
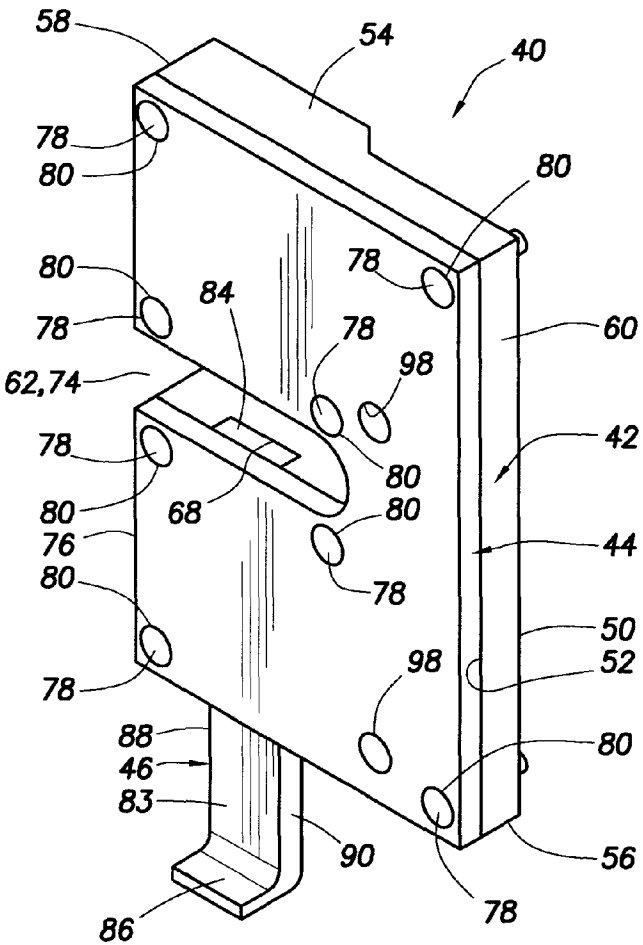
FIG. 4 is an enlarged perspective view of the bolt pin locking apparatus removed from the machine gun and being in its unlocked position.
Figure 5:
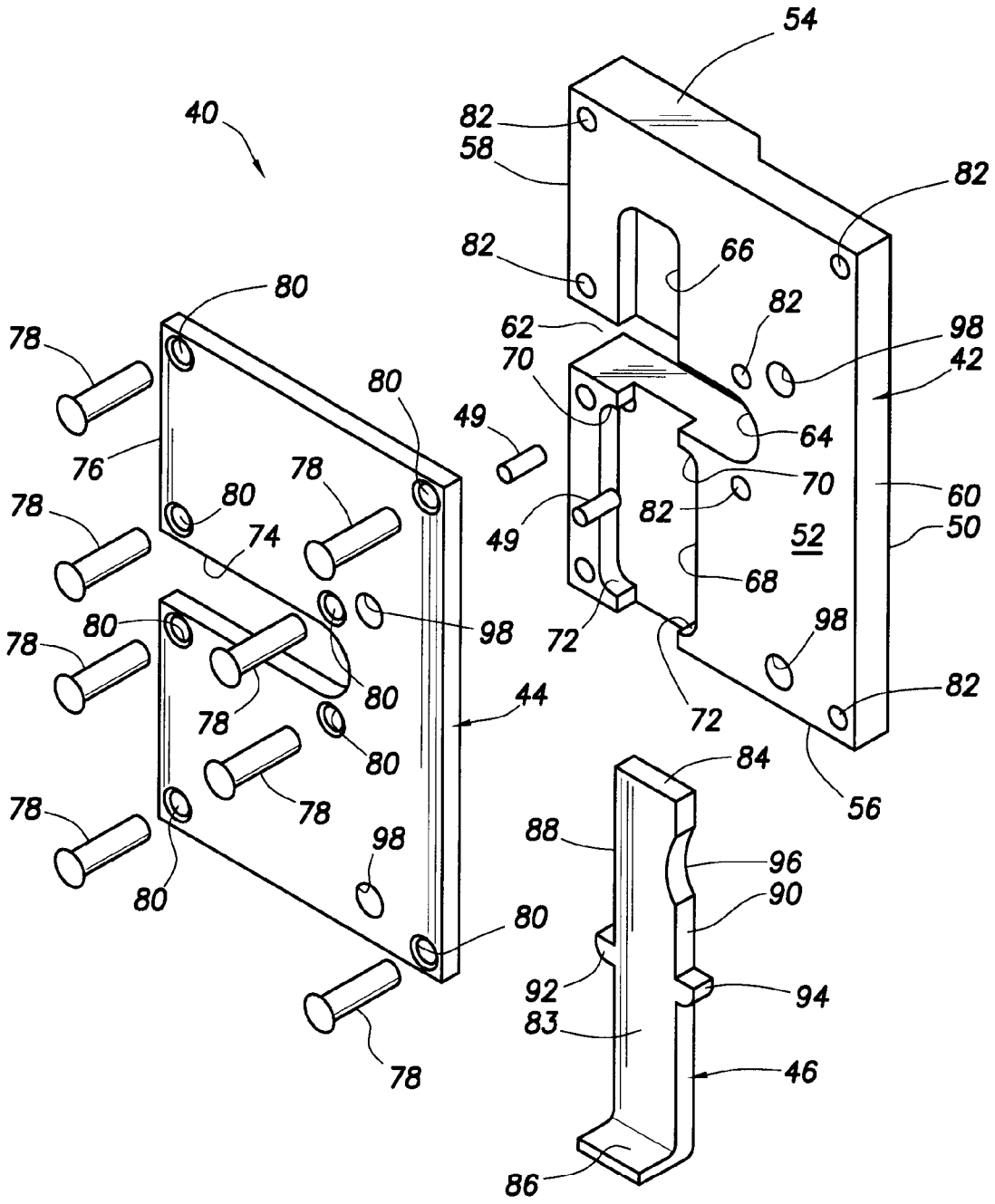
FIG. 5 is an exploded perspective view of the bolt pin locking apparatus without internal biasing spring portions thereof.

Cover plate 44 has a slot 74 horizontally extending inwardly from its front edge 76 and having a configuration identical to that of the base plate slot 62. As best illustrated in FIGS. 4 and 5, the cover plate 44 is securable to the inner side 52 of the base plate 42, illustratively by means of rivets 78 insertable into alignable opening sets 80,82 respectively extending through the cover plate 44 and the base plate 42.

With continuing reference to FIGS. 4-7, the latch member 46 has a vertically elongated, generally rectangular strip-shaped body 83 having an upper end surface 84, a transversely outwardly bent lower end portion 86, front and rear side edge surfaces 88 and 90, a pair of vertically aligned projections 92,94 respectively formed on vertically intermediate portions of the side edge surfaces 88 and 90, and an arcuate notch 96 formed on the rear side edge surface 90 and disposed between the rear projection 94 and the upper end surface 84.

Figure 6:
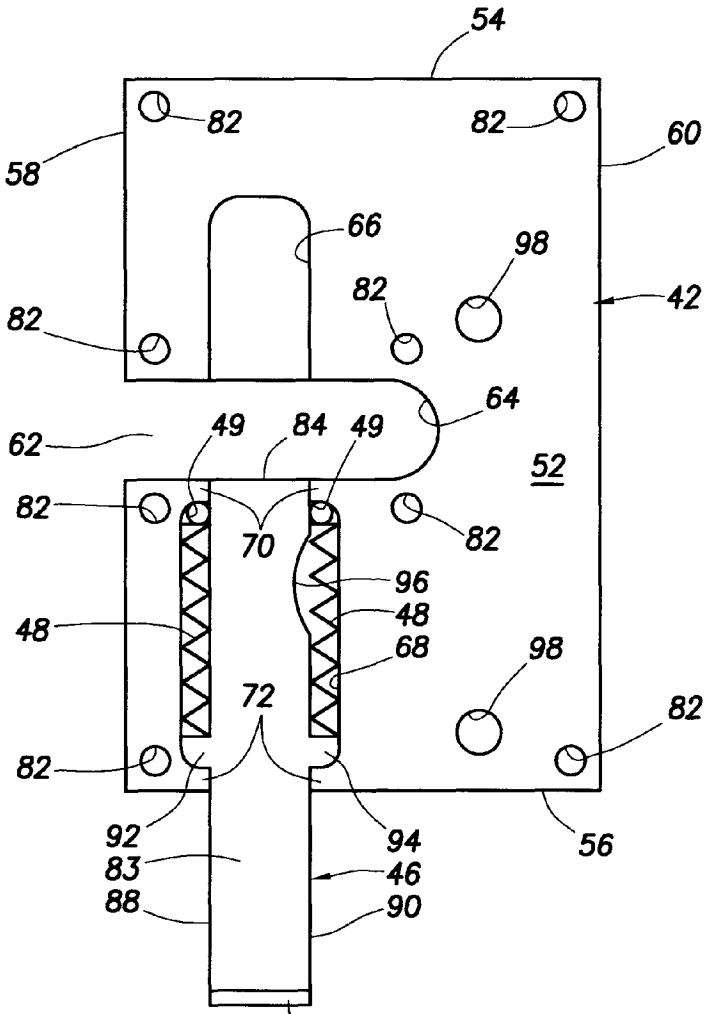
FIG. 6 is an interior side view of the bolt pin locking apparatus in its unlocked position and with its cover plate removed.

To assemble the bolt pin locking assembly 40, an upper longitudinal portion of the latch member 46 is inserted into the recess 68 in the inner side surface 52 of the base plate 42 in a manner such that the latch member side edge projections 92,94 are disposed within the recess 68 and downwardly abut the lower recess projections 72 as shown in FIG. 6. Next, the compression spring members 48 are placed in the side surface recess 68 so that the spring members 48 are on opposite front and rear sides of the latch member body 83 with the upper ends of the spring members 48 abutting the previously installed stop pins 49 and the lower ends of the spring members 48 abutting the flat upper sides of the latch member side edge projections 92,94. With the spring members 48 installed, and the latch member 46 in the position shown in FIG. 6, the spring members 48 are in their relaxed positions, and the upper end surface 84 of the installed latch member 46 is essentially flush with the bottom side of the slot 62.

As can be seen in FIG. 6, the bottom recess projections 72, the pins 49, and the body edge projections 92,94 prevent vertical removal of the installed latch member 46 from the recess 68. The installed latch member 46 may be upwardly moved from its FIG. 6 unlocking position, in which the compression spring members 48 are in relaxed orientations, to its FIG. 7 locking position in which the spring members 48 are compressed, an upper end portion of the latch member body 83 enters the upper recess 66, and the arcuate notch 96 of the latch member body 83 is disposed in a rearwardly facing orientation within the base plate slot 62. As can also be seen in FIG. 7, with the latch member 46 in this locking orientation the spring members 48 resiliently bias the latch member 46 downwardly toward its FIG. 6 unlocking position.

Finally, as illustrated in FIG. 4, the cover plate 44 is secured to the side 52 of the base plate 42 using the rivets 78 which are extended through the previously described alignable opening sets 80 and 82 in the cover plate 44 and the base plate 42. As can be seen in FIG. 4, this aligns the base plate and cover plate slots 62 and 74 to form therefrom a combined assembly slot structure 62,74. The completed bolt pin locking assembly 40 is then externally mounted on a rear side portion of the machine gun receiver 18 (as shown in FIGS. 1-3) using screws (not shown) extended through screw holes 98 formed in the base and cover plates 42,44 (see FIGS. 4-7) and then threaded into underlying holes (not visible) formed in the receiver 18. With the assembly 40 installed in this manner, the assembly slot 62,74 (see FIGS. 1-3) outwardly overlies, and is aligned with, a rear end portion of the receiver bolt pin slot 14.

When it is desired to hold the bolt assembly 19 in a rearwardly shifted orientation against the internal receiver spring force F, the charging handle 26 is pulled rearwardly to cause the bolt pin 12 to move rearwardly from its FIG. 1 forward position toward a rearward position in a manner causing the bolt pin 12 to pass rearwardly through the locking assembly slot 62,74 to a position in which the bolt pin 12 is positioned just rearwardly of the upper end of the latch member 46 which, at this point, is held in its lowered, unlocking orientation by the compression spring members 48 (see FIG. 6). With the bolt pin 12 held in its rearwardly shifted position the latch member 46 is moved upwardly to its FIG. 2 locking orientation in which the latch member arcuate notch 96 (see FIG. 7) is disposed in the assembly slot 62,74 just forwardly of the bolt pin 12. The charging handle 26 is then released to permit the internal receiver spring force F to drive a front side portion of the bolt pin 12 into forcible engagement with the arcuate latch member notch 96 as depicted in phantom in FIG. 7.

Figure 7:
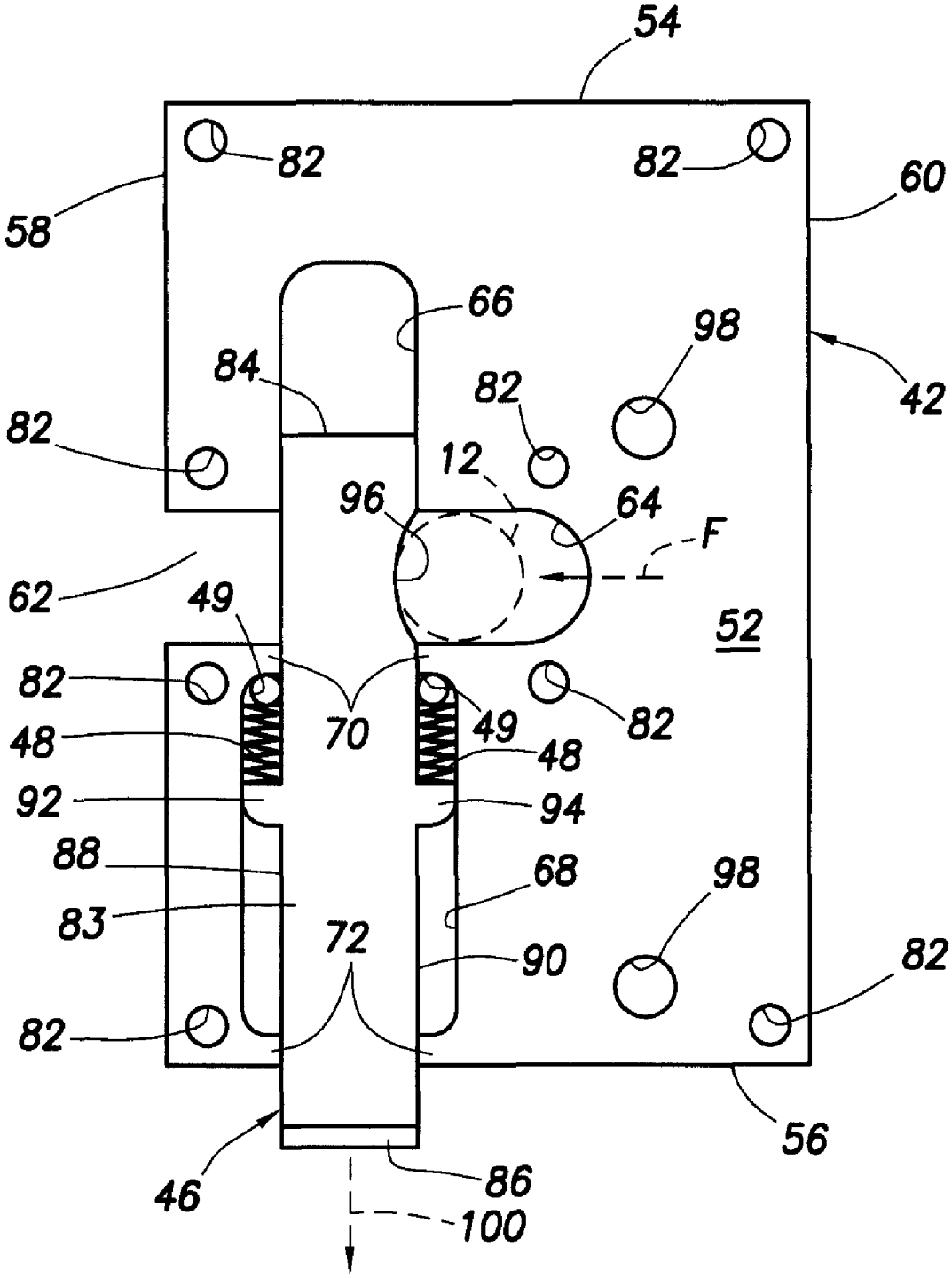
FIG. 7 is a view similar to that in FIG. 6 but with the bolt pin locking apparatus being in its locked position.

This forcible engagement of the bolt pin 12 with the notch area 96 of the latch member body 83 prevents the downward force 100 of the compression spring members 48 from returning the latch member 46 from its FIG. 7 locking position to its FIG. 6 unlocking position. As can be seen in FIG. 7, the latch member in its locking position positively blocks the rearwardly shifted bolt pin 12 (and the bolt assembly 19) from returning to its receiver spring-biased forward position, thereby allowing safe access to the receiver interior, via the receiver access door 28, with the bolt assembly 19 (via the positively blocked bolt pin 12) safely held in a rearwardly disposed orientation, and also securely holding the rearwardly shifted bolt assembly 19 (and the next-to-be-fired round which it carries) safely away from the hot gun barrel 22.

When it is desired to return the rearwardly shifted bolt assembly 19 to its forward position, all that is necessary is to pull back on and then release the charging handle 26. When the charging handle 26 is initially pulled back, to rearwardly remove the bolt pin 12 from the latch member notch 96, the downward biasing force of the compression spring members 48 downwardly snaps the latch member 46 back to its FIG. 6 unlocking position, as schematically indicated by the dashed arrow 100 in FIG. 7, thereby moving the latch member 46 out of its previous blocking relationship with the bolt pin 12. The subsequent release of the charging handle 26 permits the internal receiver spring to drive the now released bolt assembly 19 back to its forward position.

As can be seen from the foregoing, the bolt pin locking assembly 40 of the present invention is of a simple, inexpensive and rugged construction, and may be easily and quickly retrofitted onto the illustrated .50 caliber machine gun 10 or onto other types of external bolt pin-type machine guns. Further, the assembly 40 operates in a simple, reliable manner which is seen to provide a desirable improvement over previously utilized techniques for releasably holding a machine gun bolt assembly in a rearwardly shifted orientation. While the bolt pin assembly 40 is representatively depicted as being externally secured to the left receiver side wall 16, for operative receipt of the bolt pin 12, it will be readily appreciated by those skilled in this particular art that the bolt pin assembly 40 could alternatively be externally secured to the right receiver side wall 24, for operative receipt of the bolt pin 12*a* if desired, without departing from principles of the present invention.

The foregoing detailed description is to be clearly understood as being given by way of illustration and example only, the spirit and scope of the present invention being limited solely by the appended claims.

What is claimed is:

1. In combination with a machine gun having a receiver from which an outer end portion of an internal bolt pin outwardly projects, the bolt pin being movable between forward and rearward positions relative to the receiver and being spring-biased toward the forward position, bolt pin locking apparatus for releasably holding the bolt pin in its rearward position, said bolt pin locking apparatus comprising:

a body having a slot extending inwardly through an outer surface portion thereof, and a latch member carried by said body for movement relative thereto between a locking position in which said latch member extends across and blocks an outer portion of said slot, and an unlocking position in which said latch member unblocks said outer portion of said slot, said body being externally mounted on the receiver in an orientation in which, with the bolt pin in its forward position, the open end of said slot is disposed rearwardly of and faces the outer bolt pin end portion and is spaced therefrom in a manner such that when the bolt pin is moved to its rearward position it is disposed in an inner end portion of said slot and rearwardly of said latch member, the bolt pin being movable to and holdable in its rearward position to thereby move the outer bolt pin end portion into said inner end portion of said slot, the latch member being movable from its unlocking position to its locking position to thereby block forward exit of the outer bolt end portion from said slot, and the bolt pin being releasable within said slot to permit the bolt pin to be spring-driven forwardly against the latch member to thereby releasably retain the bolt pin in its rearward position.

2. The combination of claim 1 further comprising:

a biasing spring structure carried by said body and resiliently biasing said latch member toward said unlocking position thereof.

3. The combination of claim 1 wherein:

said latch member has a rear surface portion with an arcuate notch formed therein and positioned to be aligned with said slot when said latch member is in said locking position thereof.

4. The combination of claim 1 wherein:

said body has an internal passage for receiving and captively retaining said latch member for movement relative to said body into and out of said slot.

5. The combination of claim 4 wherein:

said internal passage transversely intersects said slot.

6. The combination of claim 4 wherein:

said latch member is strip-shaped and is carried by said body for longitudinal movement within said internal passage.

7. The combination of claim 6 wherein:

said internal passage extends on opposite sides of said slot, with one portion of said internal passage receiving an end portion of said latch member only when said latch member is in said locking position thereof.

8. The combination of claim 6 wherein:

said latch member has a transversely projecting portion captively retaining a portion of said latch member within said internal passage.

9. The combination of claim 8 further comprising:

a biasing spring structure disposed within said internal passage, said biasing spring structure bearing on said transversely projecting portion of said latch member and resiliently urging said latch member toward said unlocking position thereof.

10. The combination of claim 9 wherein:

said body has a plate-shaped base portion in which a groove is formed, and a cover plate removably secured to said base portion over said groove, said internal passage being defined by said groove and a side surface portion of said cover plate, and said slot extending through said base portion and said cover plate.

11. For use with a machine gun having a receiver from which an outer end portion of an internal bolt pin outwardly projects, the bolt pin being movable between forward and rearward positions relative to the receiver and being spring-biased toward the forward position, a method of releasably holding the bolt pin in its rearward position, said method comprising the steps of:

providing a bolt pin locking structure comprising a body having a slot extending inwardly through an outer surface portion thereof, and a latch member carried by said body for movement relative thereto between a locking position in which said latch member extends across and blocks an outer portion of said slot, and an unlocking position in which said latch member unblocks said outer portion of said slot;

externally mounting said bolt pin locking structure on the receiver in an orientation in which, with the bolt pin in its forward position, the open end of said slot is disposed rearwardly of and faces the outer bolt pin end portion and is spaced therefrom in a manner such that when the bolt pin is moved to its rearward position it is disposed in an inner end portion of said slot and rearwardly of said latch member;

rearwardly moving the bolt pin to, and holding it in, its rearward position to thereby move the outer bolt pin end portion into an inner end portion of said slot;

moving said latch member from its unlocking position to its locking position to thereby block forward exit of the outer bolt pin end portion from said slot; and releasing the bolt pin to permit it to be spring-driven forwardly against the latch member to thereby releasably retain the bolt pin in its rearward position.

12. The method of claim 11 further comprising the step of:

captively retaining said latch member on said body for selective movement through an interior portion thereof between said locking and unlocking positions thereof.

13. The method of claim 12 further comprising the step of:

resiliently urging said latch member toward said unlocking position thereof.

14. The method of claim 13 wherein said resiliently urging step includes the steps of:

providing a spring structure, and positioning said spring structure to operatively bear against portions of said latch member and said body.

15. The method of claim 14 further comprising the step of:

disposing said spring structure within an interior portion of said body.

16. The method of claim 11 further comprising the step of:

forming an arcuate notch on a rear surface of said latch member to be forcibly engaged by the outer bolt pin end portion within an inner portion of said slot.

17. The method of claim 16 wherein:

said latch member has a strip-shaped configuration with a rear side edge surface, and said step of forming an arcuate notch is performed by forming an arcuate notch in said rear side edge surface of said latch member.

18. For use with a machine gun having a receiver from which an outer end portion of an internal bolt pin outwardly projects, the bolt pin being movable in a first direction between forward and rearward locations on the receiver and being spring-biased toward the forward location, bolt pin locking apparatus for releasably holding the bolt pin at the rearward location on the receiver, said bolt pin locking apparatus comprising:

a body adapted to be operatively secured to the receiver adjacent the rearward location thereon and having a slot extending rearwardly through a front surface of the body and sized and configured to rearwardly receive the outer end portion of the internal bolt pin when it is moved to the rearward location on the receiver;

an elongated latch member carried by said body for longitudinal movement relative thereto, with said body operatively secured to the receiver, in a second direction transverse to the first direction between a locking position in which a portion of said latch member extends across said slot and blocks forward movement of the outer end portion of the internal bolt pin through said slot from the rearward location on the receiver, and an unlocking position in which the outer end portion of the internal bolt pin may be spring-driven from the rearward location on the receiver to the forward location thereon, said portion of said latch member having a laterally indented section configured to interfit with said outer end portion of the internal bolt pin within said slot in a manner such that the outer end portion of the internal bolt pin precludes longitudinal movement of said latch member to its unlocking position until said outer end portion of the internal bolt pin is moved rearwardly out of interfitting engagement with said latch member within said slot; and a spring structure carried by said body for resiliently urging said latch member toward said unlocking portion.

19. For use with a machine gun having a receiver from which an outer end portion of an internal bolt pin outwardly projects, the bolt pin being movable in a first direction between forward and rearward locations on the receiver and being spring-biased toward the forward location, bolt pin locking apparatus for releasably holding the bolt pin at the rearward location on the receiver, said bolt pin locking apparatus comprising:

a body adapted to be operatively secured to the receiver adjacent the rearward location thereon and having a slot extending rearwardly through a front surface of the body and sized and configured to rearwardly receive the outer end portion of the internal bolt pin when it is moved to the rearward location on the receiver;

a latch member carried by said body for movement relative thereto, with said body operatively secured to the receiver, in a second direction transverse to the first direction between a locking position in which a portion of said latch member extends across said slot and blocks forward movement of the outer end portion of the internal bolt pin through said slot from the rearward location on the receiver, and an unlocking position in which the outer end portion of the internal bolt pin may be spring-driven from the rearward location on the receiver to the forward location thereon, said portion of said latch member having a section configured to interfit with said outer end portion of the internal bolt pin within said slot in a manner such that the outer end portion of the internal bolt pin precludes movement of said latch member to its unlocking position until said outer end portion of the internal bolt pin is moved rearwardly out of interfitting engagement with said latch member within said slot; and a spring structure carried by said body for resiliently urging said latch member toward said unlocking portion, said latch member having an elongated strip shape, and said portion of said latch member comprising an indentation formed in a rear edge of an end portion of said latch member.

20. The bolt pin locking apparatus of claim 19 wherein: said indentation is an arcuate notch.

* * * * *